US005310321A

United States Patent [19]

de Koning

[11] Patent Number: 5,310,321

[45] Date of Patent: May 10, 1994

[54] PUMP SYSTEM

[75] Inventor: Cornelius J. de Koning, Ed Velden, Netherlands

[73] Assignee: Baker Hughes Incorporated, Houston, Tex.

[21] Appl. No.: 2,617

[22] Filed: Jan. 11, 1993

Related U.S. Application Data

[63] Continuation of Ser. No. 816,146, Dec. 31, 1991, abandoned, which is a continuation of Ser. No. 675,456, Mar. 26, 1991, abandoned.

[30] Foreign Application Priority Data

Jul. 24, 1990 [NL] Netherlands ..... 9001676

[51] Int. Cl.[5] ..... F04F 11/00

[52] U.S. Cl. ..... 417/54; 417/92; 417/387

[58] Field of Search ..... 417/92, 53, 54, 387, 417/389, 439

[56] References Cited

U.S. PATENT DOCUMENTS

| | | | |
|---|---|---|---|
| 1,764,712 | 6/1930 | Brackett et al. . | |
| 3,241,496 | 3/1966 | Imai et al. | 417/98 |
| 3,323,461 | 6/1967 | Bennett . | |
| 3,740,166 | 6/1973 | Seki et al. . | |
| 3,749,522 | 7/1973 | Kazama et al. | 417/92 |
| 3,938,335 | 2/1976 | Marinick . | |
| 4,378,188 | 3/1983 | Ackerman . | |
| 4,527,957 | 7/1985 | Dettinger et al. . | |
| 4,961,688 | 10/1990 | Brun . | |

FOREIGN PATENT DOCUMENTS

| | | |
|---|---|---|
| 251565 | 4/1910 | Fed. Rep. of Germany . |
| 3012028 | 10/1981 | Fed. Rep. of Germany . |
| 2209409 | 6/1974 | France . |
| 8001706 | 8/1980 | PCT Int'l Appl. . |
| 198224 | 9/1938 | Switzerland . |

*Primary Examiner*—Richard A. Bertsch
*Assistant Examiner*—Michael I. Kocharov
*Attorney, Agent, or Firm*—Coleman & Sudol

[57] ABSTRACT

A pump system includes a displacement pump whose oscillating fluid pressure variations are connected to drive a membrane pump. The membrane pump in turn oscillates fluid in a fluid-filled vertical pipe connected to a fluid-filled commuting pipe. The displacement of fluid in the commuting pipe induces intake of a fluid to be pumped into the commuting pipe during an intake portion of the oscillation and also induces expulsion of the fluid to be pumped during the remaining portion of the oscillation. The commuting pipe is made long enough so that fluid drawn in during the intake portion does not pass into the vertical pipe but stays in the commuting pipe. A heat exchanger about the vertical pipe dissipates heat that may be passed to the fluid therein by conduction or convection.

4 Claims, 1 Drawing Sheet

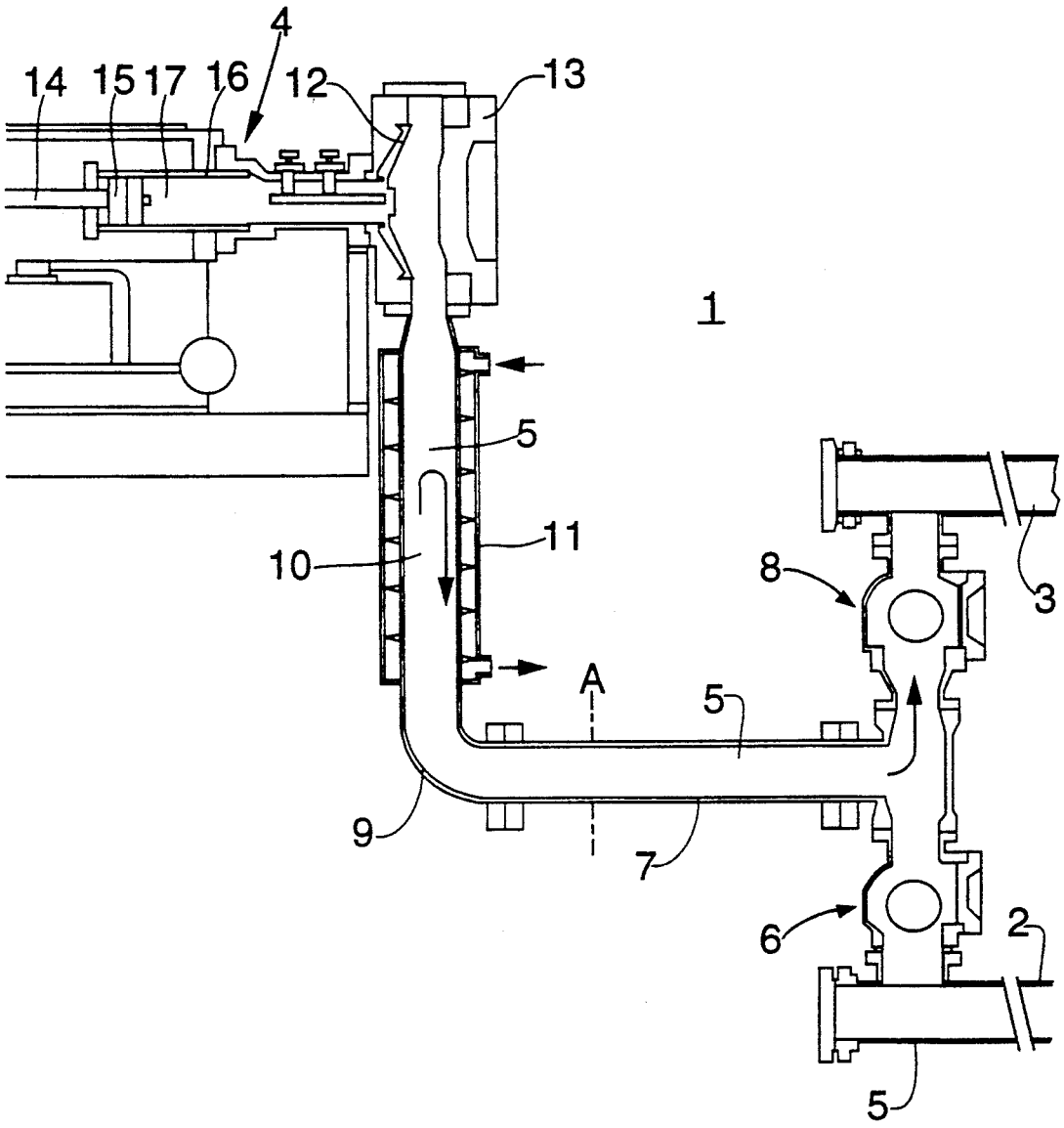
4
14
15
17
16
12
13
1
5
11
10
8
3
A
5
9
7
6
2
5

PUMP SYSTEM

CROSS REFERENCE TO RELATED APPLICATIONS

This application is a continuation of copending application Ser. No. 816,146 filed Dec. 31, 1991 now abandoned which in turn is a continuation of application Ser. No. 675,456 filed Mar. 26, 1991 and now abandoned.

BACKGROUND OF THE INVENTION

The invention relates to a pump system of the type included a displacement pump having a two-way pipe, said two-way pipe at one side being coupled, via a first non-return valve, to a supply pipe for sucking a quantity of medium from said supply pipe into said two-way pipe, said two-way pipe likewise being coupled at one side, via a second non-return valve, to a discharge pipe, in order to force a corresponding quantity of medium out of said two-way pipe, said pump system being provided with a curved pipe which is connected to the other side of said two-way pipe and which is coupled to said displacement pump.

Such a pump system is known from DE 30 12 028. The pump system known from said publication is provided with a dividing element disposed in the two-way pipe to the displacement pump, said dividing element being movable within a cylinder. At the side of the dividing element remote from the two-way pipe a working medium, which is stored in a storage vessel, is injected. The quantity of injected working medium is always larger than the losses through leakage along the displacement means. Towards the end of a delivery stroke of the displacement pump the excess working medium formed as a result of said injecting is forced through a gap between the dividing element and the wall of the cylinder, in the direction of the medium to be pumped which is present in the two-way pipe, and which may be hot. As a result of fresh and cool working medium being injected a required low operating temperature of the displacement pump is maintained, and it is prevented that the generally abrasive and hot medium comes into contact with the displacement pump. The disadvantage of the pump system described in the above-mentioned German document is inter alia that a continuous, usually undesirable dilution of the medium to be pumped takes place. A further disadvantage is that it is necessary to provide valves in order to inject fresh working medium, which valves also require regular maintenance. Besides, the storage vessel must regularly be replenished with working medium.

The object of the invention is to provide a pump system, wherein a membrane pump can be utilized for conveying in particular hot mediums, and wherein no working medium needs to be injected into the medium to be pumped at the location where the pump system is installed.

In order to achieve that objective the pump system according to the invention is characterized in that said displacement pump is a membrane pump, and that the pump system has an additional pipe, which is on the one hand connected to the curved pipe and on the other hand to the membrane pump, and that the pump system is provided with heat exchange means provided around said additional pipe.

It is noted here that the term membrane pump must be understood to mean a pump which derives its pumping action from the movement of a hermetically sealed element. The movement of said element which may have the shape of a membrane, a bellows, a hose and the like, may be imparted by means directly coupled to said element, e.g., hydraulically, pneumatically or mechanically moved means, but it may also be done indirectly. By indirect is meant that the movement of a displacement body, e.g., a piston plunger, is transmitted to the hermetically sealed element via an intermediate medium, usually a fluid.

The advantage of the pump system according to the invention is that, in particular because an additional pipe is used, it can be achieved that the hot medium itself does not come near the membrane pump when periodically moving in and out of the two-way pipe, not even if the swept volume of the membrane pump is large. As a result of that the heat which is absorbed from the hot medium by the additional pipe will mainly be conduction heat, as a result of which the heat capacity of the heat exchange means can remain minimal, in spite of the fact that for pumping the hot medium from the supply pipe to the discharge pipe a membrane pump is used that is not resistant to the heat of the medium. In the pump system according to the invention the displacement pump may thus comprise a displacement body made of an elastomeric material.

No separate working medium is required with the pump system according to the invention. When a very hot medium is pumped, a cooling medium may injected near the membrane pump, if required, which medium may readily be a portion separated from the medium to be conveyed itself, in which case said portion must be slightly cooled first. It is not necessary, however, to use a working medium other than the medium to be pumped.

A further advantage of the pump system according to the invention is that because of the slightly elastically deformable angular pipe portion, which comprises the two-way pipe, the curved pipe and the additional pipe, it is possible to allow in particular said angular pipe portion to expand and to shrink when temperature changes occur, so that it is prevented that, when mediums having widely varying temperatures are pumped, high forces are exerted and that deformations occur in the pump system at places where this is undesirable.

One embodiment of the pump system according to the invention is characterized in that the swept volume of the displacement pump is smaller than the internal volume of the two-way pipe.

The advantage of this embodiment of the pump system according to the invention is that the point located closest to the membrane pump and bounding the internal volume of the two-way pipe, which pipe is filled with sucked-in medium each time, the so-called point of reversal, lies within the two-way pipe itself. Accordingly a large amount of heat will be transferred from the hot medium only to the two-way pipe itself, and the additional pipe will not come into direct contact with the hot medium. As a result of this the heat capacity of the heat exchange means may be further reduced, in order to be able to achieve a sufficiently low temperature near the membrane pump.

Preferably the radius of curvature the curved pipe at least equals one and a half times the internal diameter of the curved pipe.

A further embodiment of the pump system according to the invention is characterized in that the additional pipe is disposed substantially vertically.

Because of this it is achieved that the point of reversal remains within the two-way pipe, and does not move through the curved pipe in the direction of the heat exchange means and the membrane pump. As a result of the action of gravity the medium near the membrane pump rather tends to go down and thus drive the point of reversal towards the two-way pipe.

The invention and its further advantages will be further explained with reference to the accompanying drawing, which illustrates a preferred embodiment of a pump system according to the invention.

BRIEF DESCRIPTION OF THE DRAWING

The sole FIGURE of the drawing is a cross-sectional view of a pump section in accordance with the present invention.

The FIGURE shows a pump system 1 comprising a supply pipe 2 and a discharge pipe 3. The pump system 1 furthermore comprises a partially illustrated displacement pump 4 for sucking a medium 5, e.g., a sludge, from the supply pipe 2, via a first one-way valve 6, into a generally horizontally disposed two-way pipe 7. Said sucking-in of the medium 5 takes place in a suction phase, which is followed by a delivery phase, during which the medium 5 collected in the two-way pipe 7 is forced, via a second one-way valve 8, into the discharge pipe 3 connected thereto. In the illustrated embodiment the two one-way valves 6 and 8 are ball valves, whereby during the suction phase the valve 6 opens and the valve 8 closes, and whereby during the delivery phase the valve 6 is closed and the valve 8 is opened.

The point of reversal or the boundary layer is indicated at A in the two-way pipe 7, said point indicating how far the medium 5 is sucked into the two-way pipe 7 before being forced out again.

A curved pipe 9 is coupled to the two-way pipe 7, and to said curved pipe 9 there is coupled a pipe 10, which is preferably disposed vertically. Around the pipe 10 heat exchange means 11 are provided, which will generally comprise a heat exchanger, through which cooling liquid may flow, in a manner and by means not shown in the FIGURE. The displacement pump 4 is a membrane pump, having a membrane 12 provided in a pump housing 13, which is coupled to the pipe 10. The membrane pump is provided with a piston rod 14, which is reciprocatingly moved by suitable driving means not shown. A displacement body 15 is secured to the piston rod 14, said displacement body being movable in a cylinder 16. If required the piston rod may directly impart a reciprocating movement to the membrane 12, but this may also be done by means of an intermediate medium 17 shown in the FIGURE, which is moved reciprocatingly by the displacement body 15 and transmits this movement to the membrane 12. The reciprocating movement of the membrane 12 results in the respective suction and delivery phases, as a result of which the medium 5 is conveyed from the supply pipe 2 to the discharge pipe 3. The amount of heat reaching the membrane 12, which is to be protected from said heat, is minimal, because the distance between the comparatively hot medium 5 and said membrane 12 is relatively large, so that the heat of the hot medium 5 present on the left of A can only reach the part of the right of A by conduction. When the medium on the left of A is heated up, this excess heat is discharged by the heat exchange means 11, as a result of which the eventual temperature increase of the membrane 12 caused by the hot medium will only be very small.

The membrane pump may be a single-acting pump, which operates in the above-described manner, but it may also be a double-acting pump, in which case an intermediate medium is also present on the left of the displacement body 15, which is able to move a membrane (not shown) and to operate a further pump system. If required also several parallel piston rods (not shown) may be provided, of course, with single-acting or double-acting displacement pumps, according to which is desired.

Generally the swept volume of the displacement pump 4 will preferably be smaller than the internal volume of the two-way pipe 7, so that the boundary layer A can stay within the two-way pipe 7. If required, cooled medium, which may be the same medium as the medium 5, may be supplied to the upper side of the pump housing 13, in order to achieve that the boundary layer A will actually stay within the two-way pipe 7.

Preferably the radius of the curved pipe 9 equals about one and a half times the internal diameter of the pipe 9, so that no blockage will occur at this location.

I claim:

1. A method for moving a fluidic medium, comprising the steps of:

providing a diaphragm pump connected via a substantially vertical pipe to a substantially horizontal commuting pipe having a smooth inner surface with a substantially uniform internal diameter along essentially the entire length of said commuting pipe between the vertical pipe and a valve unit;

operating the diaphragm pump to move a membrane of the pump in a suction direction;

in response to said step of operating and an associated suction stroke of said membrane, sucking a quantity of the fluidic medium through a one-way inlet valve of said valve unit into said commuting pipe to a boundary layer at a predetermined reversal point spaced from said vertical pipe;

actuating the diaphragm pump to move a membrane of the pump in a delivery direction opposite to said suction direction; and in response to said step of actuating and an associated delivery stroke of said membrane, forcing said predetermined quantity of the fluidic medium through a one-way outlet valve of said valve unit from said commuting pipe into a discharge pipe.

2. The method defined in claim 1, further comprising the steps of cooling said vertical pipe during said steps of operating, sucking, actuating and forcing.

3. The method .efined in claim 2 wherein said step of cooling is performed along a continuous and substantial portion of said vertical pipe.

4. The method defined in claim 1 wherein said diaphragm pump has a multitude of consecutive operating cycles, said pump being operated so that said reversal point is constantly maintained within said commuting pipe, at a substantially fixed distance from said vertical pipe.

* * * * *